US005693441A

United States Patent [19]

Gibson et al.

[11] Patent Number: 5,693,441

[45] Date of Patent: *Dec. 2, 1997

[54] METHOD AND APPARATUS FOR ELIMINATING RESIDUAL CHARGE POTENTIAL IN AN ELECTROSTATOGRAPHIC SYSTEM

[75] Inventors: George A. Gibson; James R. Larson, both of Fairport, N.Y.

[73] Assignee: Xerox Corporation, Stamford, Conn.

[ * ] Notice: The term of this patent shall not extend beyond the expiration date of Pat. No. 5,554,469.

[21] Appl. No.: 584,422

[22] Filed: Jan. 11, 1996

[51] Int. Cl.[6] ..... G03G 13/01

[52] U.S. Cl. ..... 430/45; 430/902; 361/225; 399/50; 399/168

[58] Field of Search ..... 430/45, 902; 355/219, 355/307; 361/225; 399/50, 168

[56] References Cited

U.S. PATENT DOCUMENTS 4,403,848 9/1983 Snelling ..... 355/4

4,569,584 2/1986 St. John et al. ..... 355/14 R 5,069,995 12/1991 Swidler ..... 430/115

5,510,879 4/1996 Facci et al. ..... 355/219

5,554,469 9/1996 Larson et al. ..... 430/31

*Primary Examiner*—Mark Chapman

*Attorney, Agent, or Firm*—Denis A. Robitaille

[57] ABSTRACT

An method and apparatus for eliminating residual charge potential in a multicolor electrostatographic system is disclosed, wherein a transparent conductive solution is applied to a developed image for neutralizing any charge potential therein prior to subsequent development of a superimposed electrostatic latent image. An apparatus for applying a thin layer of charge neutralizing material to the developed image is provided. In addition, various solutions have been described which may be advantageously utilized to provide a charge neutralizing material in the context of the present invention.

29 Claims, 3 Drawing Sheets

Figure 1:
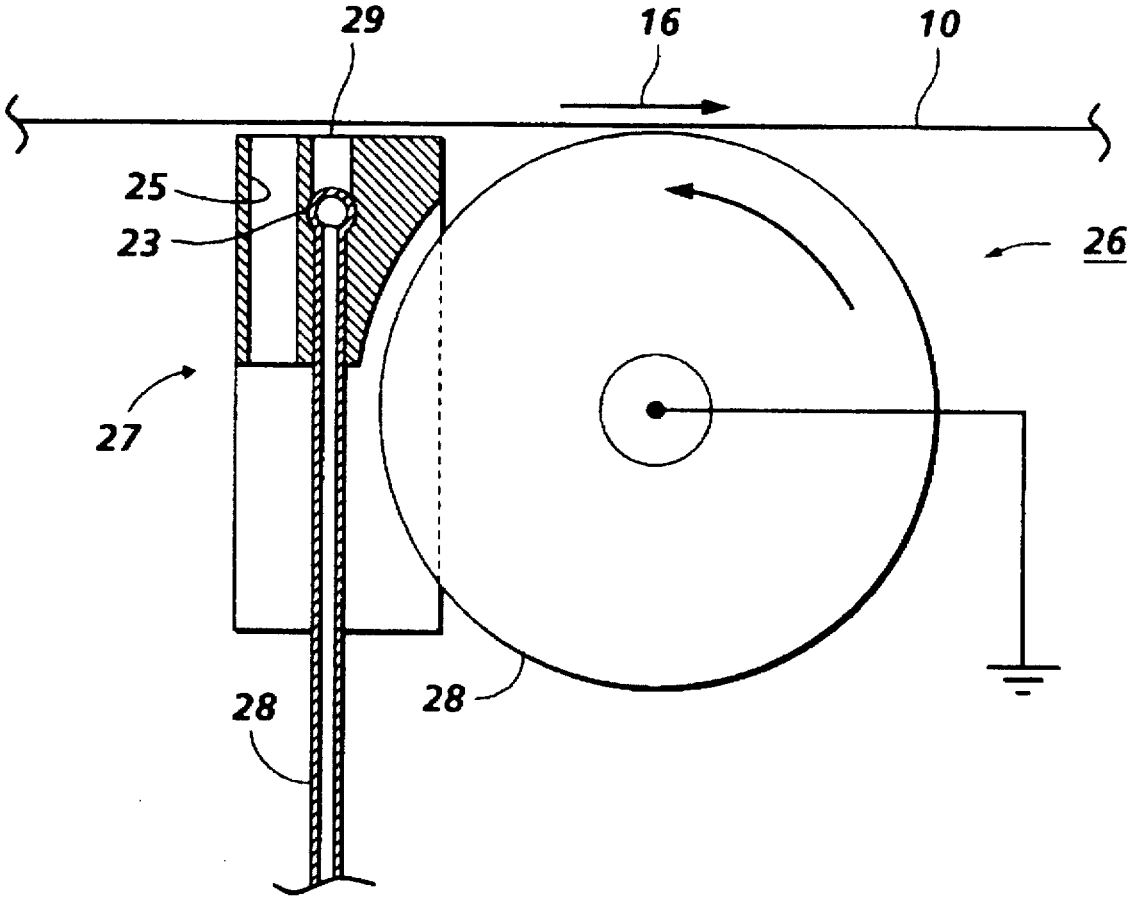

METHOD AND APPARATUS FOR ELIMINATING RESIDUAL CHARGE POTENTIAL IN AN ELECTROSTATOGRAPHIC SYSTEM

This invention relates generally to electrostatographic printing systems, and, more particularly, concerns an image-on-image multicolor system, wherein individually developed images are treated with a transparent conductive solution prior to formation of a superimposed electrostatic latent image so as to eliminate residual charge potentials which can attract toner particles in a subsequent image development procedure.

Generally, the process of electrostatographic copying is initiated by exposing a light image of an original document to a substantially uniformly charged photoreceptive member. Exposing the charged photoreceptive member to a light image discharges the photoconductive surface thereof in areas corresponding to non-image areas in the original input document while maintaining the charge in image areas, resulting in the creation of an electrostatic latent image of the original document on the photoreceptive member. This latent image is subsequently developed into a visible image by a process in which developing material is deposited onto the surface of the photoreceptive member. Typically, this developing material comprises carrier granules having toner particles adhering triboelectrically thereto, wherein the toner particles are electrostatically attracted from the carrier granules to the latent image for forming a powder toner image on the photoreceptive member. Alternatively, liquid developing materials have been utilized, comprising marking particles, or so-called toner solids, and charge directors dispersed in a carrier liquid, wherein the liquid developing material is applied to the latent image with the marking particles in the carrier liquid being attracted toward the image areas to form a developed liquid image. Regardless of the type of developing material employed, the toner or marking particles of the developing material are attracted to the latent image and subsequently transferred from the photoreceptive member to a copy substrate, either directly or by way of an intermediate transfer member. Once on the copy substrate, the image may be permanently affixed to provide a "hard copy" reproduction of the original document or electronic image. In a final step, the photoreceptive member is cleaned to remove any charge and/or residual developing material from the photoconductive surface in preparation for subsequent imaging cycles.

The above described electrostatographic reproduction process is well known and is useful for light lens copying from an original. Analogous processes also exist in printing applications such as, for example, digital laser printing where a latent image is formed on the photoconductive surface via electronically generated or stored image data and a modulated laser beam. Some of these printing processes develop toner on the discharged area, so-called DAD, or "write black" systems, while other printing processes, such as light lens generated image systems, develop toner on the charged areas, so-called CAD, or "write white" systems.

In addition to the electrostatographic copying process described above, another well known type of electrostatic imaging process involves the use of a plurality of closely spaced electrodes or styli opposed from another electrode, across which an electrical potential is selectively applied such that the air, gas or other fluid between the electrodes is ionized. This electrostatic printing process, known as ionographic printing and reproduction, involves the use of a sheet or an insulating web which is passed between the electrodes (alternatively, the electrodes are passed over the insulating web or sheet), with the electrodes being selectively energized for depositing an electrostatic charge on the sheet or web in the the area between the energized electrodes. In this manner, a charge pattern is formed on the sheet or insulating web material in accordance with the presence, absence, or intensity of the potential applied across the electrodes, producing an electrostatic latent image which may then be developed into visual form by applying toner particles to the sheet or web which adhere thereto in conformance with the latent image. The resultant developed image can then be transferred to a final copy substrate, redeveloped with a developed image of another color to form a multilayer color image, or fused to permanently affix the toner powder image to the sheet or web.

The present invention has equal application to systems which implement either of the described electrostatic printing processes.

Conventional electrostatographic reproduction processes as described hereinabove, which were originally directed toward the production of monochrome image copies or prints, have also been utilized to produce color copies or prints, including both highlight color (black plus one color) and full color or so-called process color images. In fact, the marketplace has generated a continuously increasing demand for color capabilities in various applications such that color printing and copying has become very important in the electrostatographic copying and printing industry. As these color copying and printing capabilities and technologies prove themselves in the marketplace, customers are requiring higher quality at a relatively low cost.

Thus, regardless of the type of electrostatic printing process utilized, it is highly desirable to provide the capability of producing color output prints. Electrophotographic printing machines generally utilize a so-called subtractive color mixing process to produce a color image, whereby colors are created from the three colors, namely cyan, magenta and yellow, which are complementary to the three primary colors with light being progressively subtracted from white light. In the case of electrostatographic printing machines, various methods can be utilized to produce a full process color image using cyan, magenta, and yellow toner images. One exemplary method of particular interest to the present invention for producing a process color image is described as the Recharge, Expose, and Development (REaD) process, wherein different color toner layers are deposited in superimposed registration with one another on a photoconductive surface or other recording medium to create a multilayered, multicolored, toner image thereon. In this process, the recording medium is first exposed to record a latent image thereon corresponding to a subtractive color of an appropriately colored toner particle at a first development station. Thereafter, the recording medium having the first developed image thereon is recharged and re-exposed to record a latent image thereon corresponding to another subtractive primary color and developed once again with appropriately colored toner. The process is repeated until all the different color toner layers are deposited in superimposed registration with one another on the recording medium. The multilayered toner image may then be transferred from the photoconductive surface to a copy sheet or other support substrate and the toner image is fused thereto to provide a multicolor print or copy. Variations on this general technique for forming color copies in this manner, wherein a first latent image is formed and developed and subsequent latent images are formed and developed over the first developed image in order to superimpose a plurality of toner images thereon are well known in the art, and may make advantageous use of the present invention.

Using the typical electrostatographic printing process as an example, the REaD color process described hereinabove may be implemented via either of two architectures: a single pass, single transfer architecture, wherein multiple imaging stations, each comprising a charging unit, an imaging device, and a developing unit, are situated about a single photoconductive belt or drum; or a multipass, single transfer architecture, wherein a single imaging station comprising the charging unit, an imaging device, and multiple developer units are located about a photoconductive belt or drum. As the names imply, the single pass architecture requires a single revolution of the photoconductive belt or drum to produce a color image, while the multipass architecture requires multiple revolutions of the photoconductive belt or drum to produce the color print or copy. Various other techniques and systems have been successfully implemented, wherein each color separation is imaged and developed in sequence such that each developing station (except the first developing station) must apply toner to an electrostatic latent image over areas of toner where a previous latent image has been developed. The following disclosures may be relevant to some aspects of the present invention:

U.S. Pat. No. 4,403,848

Patentee: Snelling

Issued: Sep. 13, 1983

U.S. Pat. No. 4,569,584

Patentee: St. John et al.

Issued: Feb. 11, 1986

U.S. Pat. No. 5,069,995

Patentee: Swidler

Issued: Dec. 3, 1991

U.S. patent application Ser. No. 08/331,855

Inventors: Nye et al.

Filed: Oct. 31, 1994

Commonly Assigned U.S. patent application Ser. No. (D/94841)

Inventors: Larson et al.

Filed: Dec. 1, 1995

The relevant portions of the foregoing patents may be briefly summarized as follows:

U.S. Pat. No. 4,403,848 discloses a multicolor electrophotographic printing machine in which a color separated latent image is formed on a photoconductive belt and developed with an appropriately colored toner particles. Thereafter, successive color separated latent images are formed and developed in superimposed registration with one another. In this way, a composite multicolor latent image is formed on the photoconductive belt and subsequently transferred and fused to a sheet.

U.S. Pat. No. 4,569,584 discloses a color electrographic recording apparatus for producing a composite color image on a recording medium comprising a plurality of superimposed images of different colors, eg. magenta, cyan, yellow and black. The apparatus includes means for transporting a recording medium in opposite directions along a predetermined path through the electrographic recording apparatus, a recording station located in the path, and a recording head with electrode means for forming a latent image on the recording medium. Control means are also provided for energizing the electrode means to create a latent image on the recording medium. A plurality of developing means adjacent either one side or both sides of the recording station develops a latent image produced on the recording medium into a corresponding visible image of a respective color. The transport means is operative to pass a section of the recording medium through the recording station to form a first component latent image followed by its respective color development and reverse the direction of medium transport to permit formation of a next component latent image followed by its respective color development, and is further operative to repeat this process until all component latent images and their respective color development have been completed for forming a composite color image. The color electrographic recording apparatus also includes unique registration means associated with the transport of the recording medium and the apparatus control means to form each component latent image so that all the component color images will be superimposed on one another in spite of any shrinkage or expansion of the medium during the multiple handling and processing steps of the electrographic recording process.

U.S. Pat. No. 5,069,995 discloses a liquid developer composition for use in electrophotographic processes, particularly consecutive color toning processes, wherein the composition contains toner particles of colorant-containing resin and an antistatic agent substantially immiscible with the resin, disbursed in a hydrocarbon medium. The antistatic agent effectively eliminates the image staining frequently obtained in consecutive color toning processes. Methods for preparing and using the novel composition are also provided.

U.S. patent application Ser. No. 08/331,855 discloses a liquid electrostatographic printing machine comprising a photoconductive member, wherein a REaD multicolor electrostatic printing process is accomplished through the use of liquid developing materials.

U.S. patent application Ser. No. (Attorney Docket No. D/94841) discloses a process for charging layered imaging members by the transfer or ions thereto. In particular, that patent application discloses conductive materials which may be useful as charge neutralizing materials in the context of the present invention. As such, that patent application is incorporated by reference herein.

One significant problem which has arisen in systems where sequential development occurs over previously developed images for producing a multicolor image is that the surface charge of one latent image may not be completely neutralized by the toner particles deposited thereon during a corresponding development cycle. If the electrostatic image of one color separation is not completely discharged by toner particles during a development cycle, that electrostatic image can attract toner of another color during a subsequent developing cycle. Thus, a residual charge potential may remain on the photoconductor, after a first development step which will, in turn, be developed by another color in a subsequent development step. This phenomenon is known as staining.

The present invention contemplates a process and apparatus for eliminating staining by the treatment of each color separated developed image (except the final image) with a transparent conductive solution to substantially eliminate residual charge prior to formation of a subsequent color separated latent image and development thereof. In accordance with the present invention, each developed image is passed through an accompanying post-development treatment station prior to subsequent sequential imaging and development cycles, wherein the post-development treatment station includes a material applicator for applying a stain eliminating conductive solution to the developed image on the photoreceptor. The conductive solution is formulated to neutralize any residual charge on the photoconductor, and, in particular, the previously developed image, by causing the development of colorless charged ions on the photoreceptor. The process and apparatus of the present invention substantially eliminates the residual charge which causes the previously described phenomenon of staining.

In accordance with one aspect of the present invention, there is provided an electrostatographic printing machine for producing a multicolor output image from an input image signal, comprising: a recording medium adapted to have a plurality of latent electostatic images recorded thereon; means for generating a first electrostatic latent image on the recording medium corresponding to a first color separation of the input image signal; means for developing the first electrostatic latent image on the recording medium with a developing material to produce a first developed image thereon; means for generating a second electrostatic latent image on the recording medium corresponding to a second color separation of the input image, the second electrostatic latent image being superimposed on the first developed image on the recording medium; means for developing the second electrostatic latent image on the recording medium with a developing material to produce a second developed image thereon; and means for applying a conductive solution to the first developed image prior to formation of the second electrostatic latent image superimposed thereon, the conductive solution including a charge neutralizing material operative to substantially eliminate residual charge potentials which may remain on the recording medium from the first electrostatic latent image after development thereof.

In accordance with another aspect of the present invention, there is provided an electrostatographic printing process for producing a multicolor output image from an input image signal, comprising the steps of: providing a recording medium adapted to have a plurality of latent electostatic images recorded thereon; generating a first electrostatic latent image on the recording medium corresponding to a first color separation of the input image; developing the first electrostatic latent image on the recording medium with a developing material to produce a first developed image thereon; generating a second electrostatic latent image on the recording medium corresponding to a second color separation of the input image, the second electrostatic latent image being superimposed on the first developed image on the recording medium; developing the second electrostatic latent image on the recording medium with a developing material to produce a second developed image thereon; and applying a conductive solution to the first developed image prior to formation of the second electrostatic latent image superimposed thereon, the conductive solution including a charge neutralizing material operative to substantially eliminate residual charge potentials which may remain on the recording medium from the first electrostatic latent image after development thereof.

Figure 2:
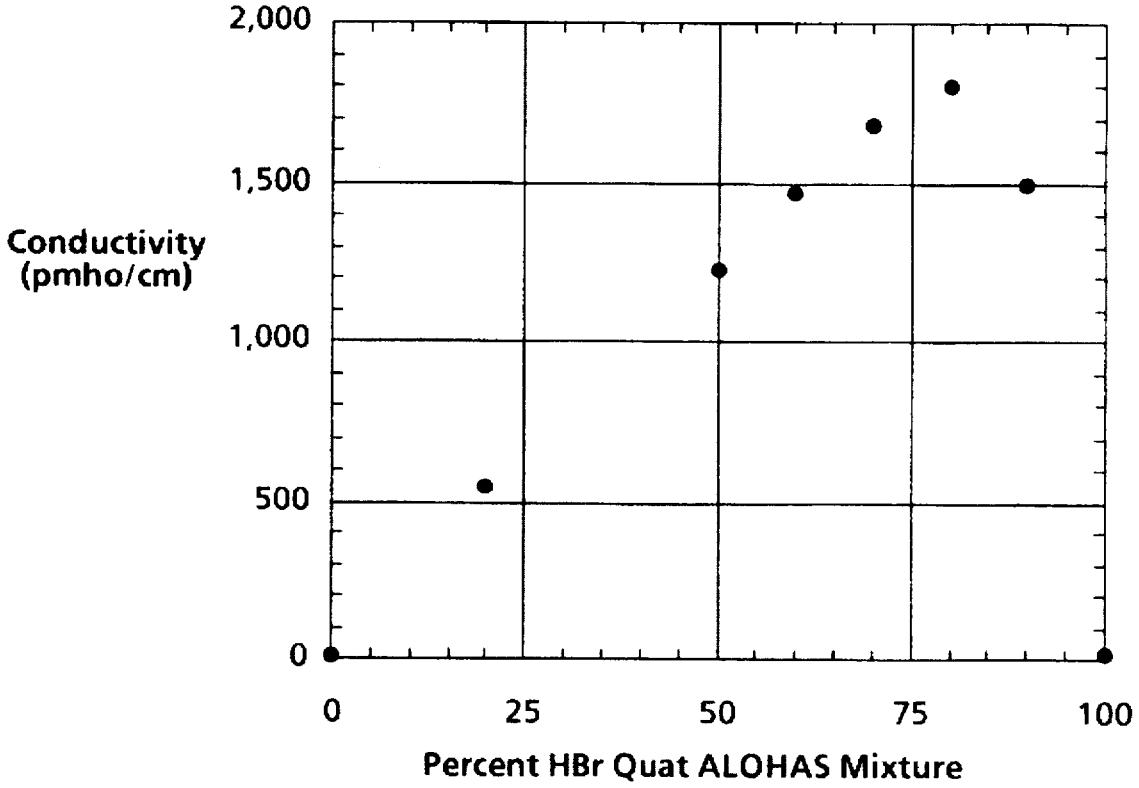
Figure 3:
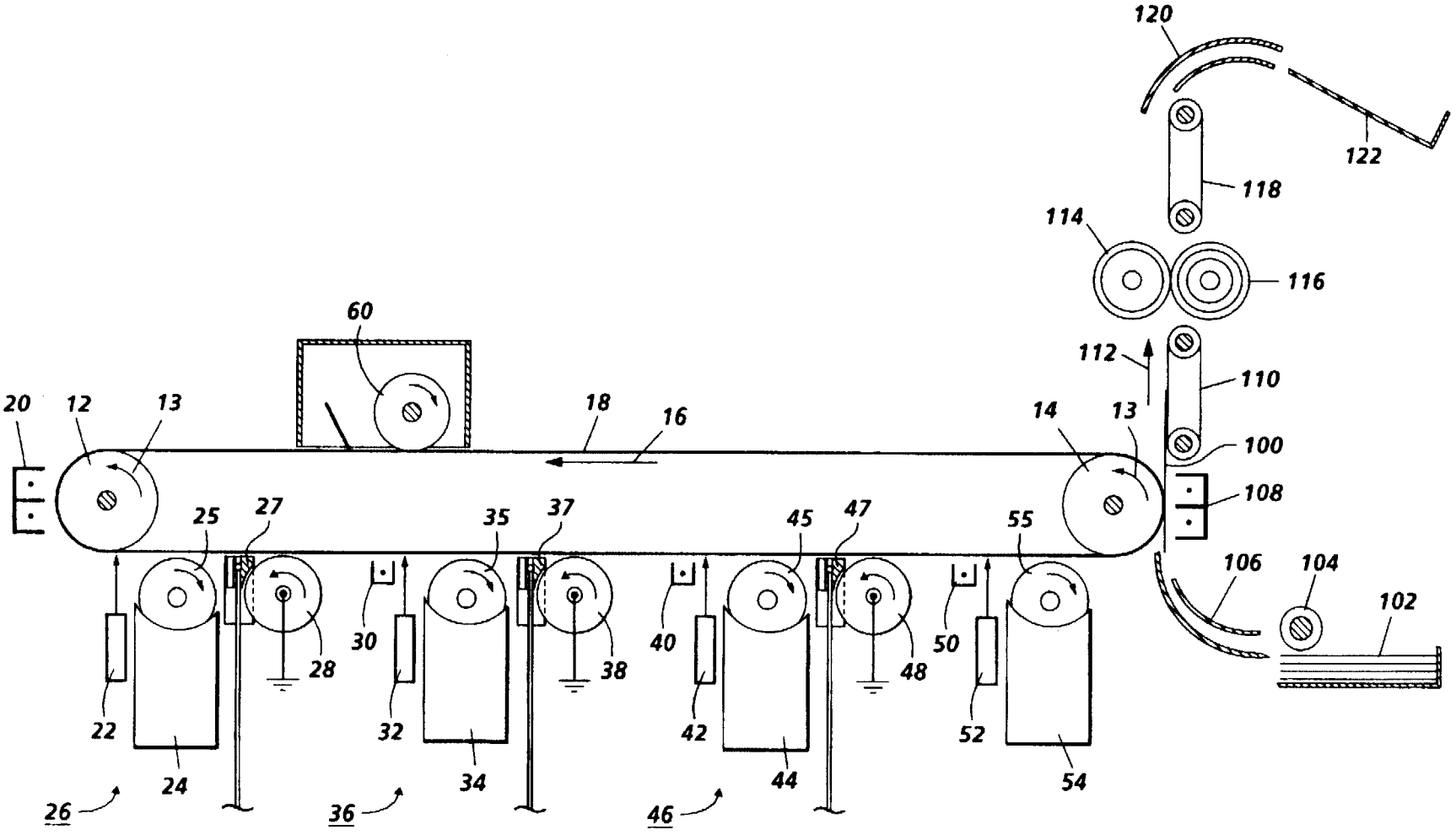

Other aspects of the present invention will become apparent as the following description proceeds and upon reference to the drawings, in which:

FIG. 1 is a schematic, elevational view of an exemplary post-development treatment station in accordance with the present invention, including an exemplary liquid material applicator system which could be utilized in the method and apparatus for eliminating residual charge potential in an electrostatographic system as disclosed by the present invention;

FIG. 2 is a graphical representation of the conductivity versus weight percent of a certain mixture of HBr quat salts and ALOHAS as an exemplary charge neutralizing material contemplated for use by the present invention; and FIG. 3 is a schematic, elevational view of an exemplary color electrostatographic printing machine incorporating the method and apparatus for eliminating residual charge potential in accordance with the present invention.

For a general understanding of the features of the present invention, reference is made to the drawings, wherein like reference numerals have been used throughout to designate identical elements. FIG. 3 is a schematic elevational view illustrating an exemplary full-color electrostatographic printing machine incorporating the features of the present invention. Inasmuch as the art of electrostatographic printing is well known, the various processing stations employed in the printing machine of FIG. 3 will be described briefly prior to describing the invention in detail. It will become apparent from the following discussion that the apparatus of the present invention may be equally well suited for use in a wide variety of printing machines and is not necessarily limited in its application to the particular electrostatographic machine described herein. For example, it will be explicitly understood that the method and apparatus of the present invention may find application in a dry toner-type electrostatographic printing machine, a liquid developing material-type electrostatographic printing machine as well as an ionographic printing apparatus. Moreover, while the present invention will hereinafter be described in connection with a preferred embodiment thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIG. 3, a multicolor electrostatographic printing machine is shown, incorporating the features of the present invention therein. The printing machine employs a photoreceptive belt 10 which comprises a mutilayered structure, including a photoconductive surface deposited on an electrically grounded conductive substrate, wherein the photoconductive surface is preferably made from a selenium alloy and the conductive substrate is preferably made from an aluminum alloy. The photoreceptive belt 10 is rotated along a curvilinear path defined by rollers 12 and 14 for advancing successive portions of the photoreceptive belt 10 sequentially through the various processing stations disposed about the path of movement thereof. These rollers are spaced apart with roller 12 being rotatably driven in the direction of arrow 13 by a suitable motor and drive system (not shown) with roll 14 rotating in the direction of arrow 15 so as to advance belt 10 in the direction of arrow 16.

Initially, the belt 10 passes through a charging station, whereat a corona generating device 20 charges the photoconductive surface of belt 10 to relatively high, substantially uniform potential.

After the substantially uniform charge is placed on the photoreceptive surface of the belt 10, the electrostatographic printing process proceeds by either placing an input document onto the surface of a transparent imaging platen for imaging thereof or by providing a computer generated image signal for discharging the photoconductive surface in accordance with the image to be generated. For multicolor printing and copying, the imaging process involves separating the imaging information into the three primary colors to provide a series of subtractive imaging signals, with each subtractive imaging signal being proportional to the intensity of the incident light of each of the primary colors. These imaging signals are then transmitted to a series of individual raster output scanners (ROSs) 22, 32, 42 and 52 for generating complementary, color separated latent images on the charged photoreceptive belt 10. Typically, each ROS 22, 32, 42 and 52 writes the latent image information in a pixel by pixel manner.

In the exemplary electrostatographic system of FIG. 3, each of the color separated electrostatic latent images are serially developed on the photoreceptive belt 10 via a donor roll developing apparatus 24, 34, 44 and 54. Each developing apparatus transports a different color developing material into contact with the electrostatic latent image on the photoreceptor surface so as to develop the latent image with pigmented toner particles to create a visible image. By way of example, developing apparatus 24 transports cyan colored developer material, developing apparatus 34 transports magenta colored developer material, developing apparatus 44 transports yellow colored developer material, and developing apparatus 54 transports black colored developer material. Each different color developing material comprises pigmented toner particles, wherein the toner particles are charged to a polarity opposite in polarity to the latent image on the photoconductive surface of belt 10 such that the toner particles are attracted to the electrostatic latent image to create a visible developed image thereof.

In a typical donor roll developing apparatus, a donor roll 25, 35, 45 or 55 is coated with a layer of appropriately colored developer material, and is rotated to transport the toner to the surface of belt 10, where the latent image on the surface of belt 10 attracts the toner thereto for producing the visible developed image. The donor roll may also be electrically biased to a suitable magnitude and polarity for enhancing the attraction of the toner particles to the latent image. Each of the developer units 24, 34, 44 and 54 are substantially identical to one another and represent only one of various known apparatus that can be utilized to apply developing material to the photoconductive surface or any other type of recording medium. Moreover, it will also be recognized that the present description is directed to a general description of a multicolor printing system into which the present invention may be incorporated. It will also be recognized that the development systems described herein may include additional subsystems such as, for example, an image conditioning system as described in commonly assigned U.S. patent application Ser. No. 08/331,855, among other patents and publications.

The first color separated electrostatic latent image is developed at developing station 24 using cyan colored developer material. Thereafter, the belt 10 continues to advance in the direction of arrow 16 to a first post-development station 26, which will be described in greater detail below, and then to a recharge station where corona generating device 30 which recharges the photoconductive surface of belt 10 to a substantially uniform potential. Continuing to the next exposure station, ROS 32 selectively dissipates the charge laid down by corotron 30 to record another color separated electrostatic latent image corresponding to regions to be developed with a magenta developer material. This color separated electrostatic latent image may be totally or partially superimposed on the developed cyan image on the photoconductive surface of belt 10. This electrostatic latent image is now advanced to the next successive developing apparatus 34 which deposits magenta toner thereon.

After the electrostatic latent image has been developed with magenta toner, the photoconductive surface of belt 10 continues to be advanced in the direction of arrow 16 to the next post-development station 36 and onward to corona generating device 40, which once again, charges the photoconductive surface to a substantially uniform potential. Thereafter, ROS 42 selectively discharges this new charge potential on the photoconductive surface to record yet another color separated electrostatic latent image, which may be partially or totally superimposed on the prior cyan and magenta developed images, for development with yellow toner. In this manner, a yellow toner image is formed on the photoconductive surface of belt 10 in superimposed registration with the previously developed cyan and magenta images. It will be understood that the color of the toner particles at each development station may be provided in am arrangement and sequence that is different than described herein.

In a final development step, after the yellow toner image has been formed on the photoconductive surface of belt 10, the belt 10 continues to advance to the next post-development station 46 and onward to recharge station 50 and corresponding ROS 52 for selectively discharging those portions of belt 10 which are to be developed with black toner. In this final, black development step, known as black undercolor removal process, the developed image is located only on those portions of the photoconductive surface adapted to have black in the printed page and is not superimposed over the prior cyan, magenta, and yellow developed images. In this way, a composite multicolor toner image is formed on the photoconductive surface of belt 10.

The composite multicolor developed image is next advanced to a transfer station, whereat a sheet of support material 100, such as paper or some similar sheetlike substrate, is advanced from a stack 102 by a feed roll 104. The sheet advances through a chute 106 and is guided to the transfer station thereby. A corona generating device 108 sprays ions onto the back side of the paper 100 for attracting the composite multicolor developed image on belt 10 to the sheet of support material 100. A conveyor belt 110 moves the sheet of paper in the direction of arrow 112 to a drying or fusing station. While direct transfer of the composite multicolor developed image to a sheet of paper has been described, one skilled in the art will appreciate that the developed image may be transferred to an intermediate member, such as a belt or drum, and then, subsequently, transferred and fused to the sheet of paper, as is well known in the art. The fusing station includes a heated roll 114 and back-up or pressure roll 116 resiliently urged into engagement with one another to form a nip through which the sheet of paper passes. The fusing station operates to affix the toner particles to the sheet of copy substrate so as to bond the multicolor image thereto. After fusing, the finished sheet is discharged onto a conveyor 118 which transports the sheet to a chute 120 and guides the sheet into a catch tray 122 for removal therefrom by the machine operator.

Often, after the developed image is transferred from belt 10, residual developer material tends to remain, undesirably, on the surface thereof. In order to remove this residual toner from the surface of the belt 10, a cleaning roller 60, typically formed of an appropriate synthetic resin, is driven in a direction opposite to the direction of movement of belt 10 for contacting and cleaning the surface thereof. It will be understood that a number of photoconductor cleaning means exist in the art, any of which would be suitable for use with the present invention.

It will be recognized that the foregoing description is directed toward a Recharge, Expose, and Develop (REaD) process for systematically recharging and re-exposing a photoconductive member to record latent images thereon, whereby, a charged photoconductive surface is serially exposed to record a series of latent images thereon corresponding to the subtractive color of one of the colors of the appropriately colored toner particles at a corresponding development station, with the different color toner layers being deposited in superimposed registration with one another on the photoconductive surface of belt 10. It should be noted that either discharged area development (DAD) techniques, wherein discharged portions are developed, or charged area development (CAD) techniques, wherein charged areas are developed, can be employed, as are well known in the art. Moreover, it will be noted that analogous processes exist which may incorporate the post-development treatment of the present invention. Of particular interest is the ionographic-type printing process, wherein multiple color separated latent images are recorded on a dielectric recording medium.

As previously noted, a significant problem which exists in systems where sequential development steps are conducted over previously developed images in order to produce a multicolor image arises when the surface charge of one latent image is not completely neutralized by the toner particles deposited during the corresponding development cycle. The incomplete dissipation of charge in an electrostatic latent image of one color separation during a development cycle results in the attraction of toner particles of another color by that electrostatic image during a subsequent developing cycle. Thus, a phenomenon known as "staining" is common in multicolor printing and is caused by residual charge potentials after a development cycle, which, in turn, may be developed by another color in a subsequent development cycle.

The present invention contemplates a process and apparatus for eliminating staining by passing each developed image through a corresponding post -developing process step prior to subsequent sequential imaging and development. A post-development treatment station is provided, including a charge neutralizing material applicator for applying a conductive solution to the latent image. The conductive solution neutralizes any residual charge on the photoconductor, and, in particular, the previously developed image, by causing the development of colorless charged ions, thereby eliminating the residual charge which causes the previously described staining phenomenon. An exemplary material applicator for depositing the charge neutralizing material on the latent image will be described, followed by a description of some exemplary charge neutralizing materials which may be useful in the context of the present invention, for extinguishing residual charge left on the photoconductive surface by flooding the photoconductive surface therewith.

Thus, in accordance with the present invention, after image development of the first developed image on the surface of belt 10, the developed image is advanced to a post-development treatment station 26, including a material applicator, wherein a charge neutralizing material is applied to the developed image on the surface of the belt 10. An exemplary material applicator for delivering such a charge neutralizing material will be described hereinafter with reference to FIG. 1. It will be understood that a charge neutralizing material applicator in accordance with the present invention may take many forms, as for example, similar to the liquid developer systems described in U.S. Pat. Nos. 4,733,273; 4,883,018; and 5,355,201, among various other patents and publications, wherein a liquid material is delivered to the photoconductive surface of a belt or drum photoreceptor.

Referring now to FIG. 1, an exemplary post-development treatment station 26 will be described with an understanding that the post-development treatment stations 36 and 46, shown in FIG. 3, are identical thereto. As depicted in FIG. 1, the post-development treatment station 26 includes a liquid material applicator 27 coupled to a charge neutralizing material supply reservoir (not shown) via supply line 21 and further includes a metering roll 28 situated adjacent to the applicator 27. Both metering roll 28 and applicator 27 in close proximity to the surface of photoreceptive belt 10 are situated for applying the charge neutralizing material to the surface thereof. Supply line 21 acts as a conduit for supplying an operative solution of charge neutralizing material to the material applicator 27.

The exemplary material applicator 27 includes an elongated aperture 29 extending along a longitudinal axis oriented substantially transverse to the surface of photoreceptor belt 10, along the direction of travel thereof, as indicated by arrow 16. The aperture 29 provides a path of travel for the charge neutralizing material while defining a charge neutralizing material application region in which the charge neutralizing material can freely flow in order to contact the surface of the photoreceptor belt 10. Thus, a charge neutralizing material is pumped through the supply line 21 to the applicator 27, through at least one inlet port 23, such that the charge neutralizing material flows out of the elongated aperture 29 and into contact with the surface of photoreceptor belt 10. An overflow drainage channel (not shown) partially surrounds the aperture 29 for collecting excess charge neutralizing material which may not be deposited on the photoreceptor surface. The overflow channel is connected to an outlet port 25 for removal of excess or extraneous charge neutralizing material and, preferably, for directing this excess material to a sump (not shown) whereat the charge neutralizing material can be collected and/or recycled for subsequent use.

Slightly downstream of and adjacent to the material applicator 27, in the direction of movement of the photoreceptor 10, is a metering roller 28, the peripheral surface thereof being situated in close proximity to the surface of the photoreceptor 100. The metering roller 28 has a peripheral surface situated in close proximity to the surface of the photoreceptor 10 and is preferably rotated in a direction opposite the path of movement thereof. In this manner, the metering roller 28 applies a substantial shear force to the thin layer of charge neutralizing material present between it and the photoreceptor 10, for minimizing the amount of the charge neutralizing material deposited on the photoconductive surface. This shear force removes a predetermined amount of excess charge neutralizing material from the surface of the photoreceptor and transports this excess charge neutralizing material in the direction of the material applicator 27. The excess developing material eventually falls away from the rotating metering roll 28 for collection in the sump, as previously described. The metering roll 28 is preferably coupled to ground for providing an electrical path through the metering roll 28 for eliminating residual charge potentials contacted by the charge neutralizing material. However, it will be recognized by those of skill in the art that the metering roll 28 could be electrically biased by supplying a DC voltage thereto for providing additional treatment of the image on the photoreceptor. For example, by providing a predetermined electrical bias at the metering roll which is similar in polarity to the charge of the developed image, compression or so-called rigidization of the image on the photoreceptor could be induced. Conversely, by providing a predetermined electrical bias at the metering roll which is opposite in polarity to the charge of the developed image, background image removal could be induced.

In operation, liquid charge neutralizing material is pumped through inlet ports 23 into the elongated aperture 19. The charge neutralizing material flows through the aperture 19 in the direction of the photoreceptor 10, filling the gap between the surface of the photoreceptor and the material applicator 27. As the belt 10 moves in the direction of arrow 16, a portion of the charge neutralizing material is transported therewith in the direction of the metering roll 28. The metering roll meters a predetermined amount of liquid charge neutralizing material adhering to the photoconductive surface of belt 10 and transports extraneous charge neutralizing material away from the photoreceptor. It will be appreciated that the procedure and apparatus described above, and illustrated in FIG. 1, is not restricted to use only in a printer of the type illustrated in FIG. 3 and a similar procedure could be applied to other types of electrostatographic printers and digital copiers and may also be usable in combination with dielectric charge receivers, for ionographic printing and the like.

General examples of alternative systems which may be utilized for contacting the liquid charge neutralizing material to the surface of the photoreceptor can be characterized as follows:

The charge neutralizing fluid itself may be directly contacted with the photoreceptor surface by allowing the liquid material to impinge upon the surface through a slot in a container or reservoir. In this example, the liquid must be sealed to prevent leaking out of the reservoir. Typically an elastomeric gasket or shoe is utilized, having a durometer selected so as to allow it to conform to the asperities in the photoreceptor surface and to any curvature in the photoreceptor, such as a drum. Any droplets which may transfer to the surface can be wiped away by a wiper blade, for example.

The charge neutralizing fluid can also be contacted to the surface by imbibing an absorbent blade member with the fluid, wherein the blade is contacted with the surface of the imaging member in a wiping manner. The blade can be comprised of an absorbent felted material, or an open cell foam, for example, mounted onto a support and continually moistened from a reservoir containing the charge neutralizing conductive fluid. A wiper blade can be located downstream in the process direction of the blade, insuring that droplets of fluid do not transfer to the surface of the imaging member.

It will be appreciated by those of skill in the art that, while the present invention contemplates the deposition of a conductive surfactant charge additive on a developed image, the conductivity of the additive should be limited. That is, while increased conductivity is the desired state, such increased conductivity must not effect the lateral conductivity of subsequent latent images which may result in image quality defects. In addition, the increased conductivity provided by the present invention must be tailored to prevent image quality defects which may be induced thereby during the electrostatic transfer process.

Moving now to a description of some exemplary materials which may be utilized for providing a charge neutralizing material for eliminating residual charge potential in electrostatographic systems, it is preferred that the charge neutralizing material be supplied in the form of a liquid material comprising a liquid carrier medium having a conductive surfactant charge additive immersed therein. The liquid carrier medium is usually present in an amount of from about 80 to about 99.9 percent by weight, although this amount may vary from this range provided that the objectives of the present invention are achieved.

By way of example, the liquid carrier medium may be selected from a wide variety of materials, including, but not limited to, any of several known aliphatic hydrocarbon liquids conventionally employed for liquid ink development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include: Amsco® 460 Solvent and Amsco® OMS, available from American Mineral Spirits Company; Soltrol®, available from Phillips Petroleum Company; Pagasol®, available from Mobil Oil Corporation; Shellsol®, available from Shell Oil Company; and the like. Isoparaffinic hydrocarbons provide a preferred nonpolar liquid carrier medium, since they are colorless and environmentally safe. Another characteristic of such isoparaffinic hydrocarbons, which may be desirable in some cases, is that they typically possess a sufficiently high vapor pressure so that a thin film of the liquid evaporates from the contacting surface within seconds at ambient temperatures.

In addition to the foregoing liquid carrier vehicle materials, the charge neutralizing material includes a surfactant charge control additive for facilitating the charge neutralization desired by the present invention. Examples of suitable surfactant charge additive compounds include lecithin, available from Fisher Inc.; OLOA 1200, a polyisobutylene succinimide, available from Chevron Chemical Company; basic barium patronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The surfactant charge control additive may be present in an amount of from about 0.01 to about 3 percent by weight, and preferably from about 0.02 to about 0.05 percent by weight of the charge neutralization composition.

The charge neutralizing material, selected in embodiments, contains mixed surface active agents or so-called surfactants that, for example, increase the conductivity of the liquid carrier material by orders of magnitude relative to liquid carrier material absent such surfactant solutions. Additional examples of charge neutralizing solutions include those containing mixed surfactants or charge additives of polymeric ammonium HBr salts, preferably poly[H,N-dimethyl-N-ethyl methacrylate ammonium bromide (A block)-co-2-ethylhexyl methacrylate (B block)] and salicylic aluminate, and more specifically, hydroxybis[3,5-di-t-butyl salicylic aluminate monohydrate] (ALOHAS), include those as illustrated in U.S. Pat. No. 5,366,840 and U.S. Ser. No. 065,414, now U.S. Statutory Invention Registration H1483, the disclosures of which are totally incorporated herein by reference. For example, a liquid carrier solution with an 80/20 mixture of poly[N,N-dimethyl-N-ethylmethacrylate ammonium bromide (A block)-co-2-ethylhexyl methacrylate (B block)] and ALOHAS enables a charge neutralizing fluid conductivity of about 100 times greater than the same concentration of the individual components. More specifically, charge additives include AB diblock, ABA triblock, BAB triblock copolymers or mixtures thereof with a $M_w$ of from, for example, about 2,000 to about 250,000, and wherein, for example, the A blocks are comprised of the repeat units of N,N-dimethyl-ammonium-N-ethyl methacrylate bromide salt, and the B block is comprised of repeat units of 2-ethylhexyl methacrylate, reference the block copolymer poly[N,N-dimethyl-N-ethylmethacrylate ammonium bromide (A Block)-co-2-ethylhexyl methacrylate (B Block)]. The diblock ammonium bromide copolymers are illustrated in U.S. Ser. No. 065,414, now U.S. Statutory Invention Registration H1483; the ABA triblocks in copending application U.S. Ser. No. 231,086; and the BAB triblocks in copending application U.S. Ser. No. 519,265, the disclosures of which are totally incorporated herein by reference. Also, in embodiments, the liquid charge neutralizing fluid composition is essentially free of thermoplastic resin and pigment so as to be substantially transparent.

Specific embodiments of the liquid charge neutralizing fluid comprise a nonpolar liquid carrier component and a mixture of a first surfactant charge additive comprised of an ammonium AB diblock copolymer, wherein the the B:A molar ratio is from about 0.1:99.9 to about 99.9:0.1 in the polymeric ammonium salt surfactant; and a second surfactant charge additive or adjuvant comprised of an aluminum hydroxy carboxylic acid component. In embodiments, a number of ammonium AB diblocks can be selected in a variety of mole ratios, such that, when mixed with an aluminum hydroxy carboxylic acid adjuvant, a hydrocarbon soluble ionized fluid is enabled.

Examples of specific AB diblock copolymer surfactants present in various effective amounts include poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexy( acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], poly[2-dimethylammoniumethyl methacrylate tosylate co-N,N-dibutylacrylamide], poly[4-vinyl-N,N-dimethylanilinium bromide co-2-ethylhexyl methacrylate], poly[4-vinyl-N,N-dimethylanilinium tosylate co-2-ethylhexyl methacrylate], poly[ethylenimmonium bromide co-2-ethylhexyl methacrylate], poly[propylenimmonium bromide co-2-ethylhexyl methacrylate], poly[N,N-dimethyl-N-ethyl methacrylate ammonium bromide (A block)-co-2-ethylhexyl methacrylate (B block)], poly[N,N-dimethyl-N-ethyl methacrylate ammonium tosylate (A block)-co-2-ethylhexyl methacrylate (B block)], poly[N,N-dimethyl-N-ethyl methacrylate ammonium chloride (A block)-co-2-ethylhexyl methacrylate (B block)], poly[N,N-dimethyl-N-ethyl methacrylate ammonium bromide (A block)-co-2-ethylhexyl acrylate (B block)], poly[N,N-dimethyl-N-ethyl acrylate ammonium bromide (A block)-co-2-ethylhexyl methacrylate (B block)], poly[N,N-dimethyl-N-ethyl acrylate ammonium bromide (A block)-co-2-ethylhexyl acrylate (B block], poly[N,N-dimethyl-N-ethyl methacrylate ammonium tosylate (A block)-co-2-ethylhexyl acrylate (B block)], poly[N,N-dimethyl-N-ethyl acrylate ammonium tosylate (A block)-co-2-ethylhexyl acrylate (B block)], poly[N,N-dimethyl-N-ethyl methacrylate ammonium chloride (A block)-co-2-ethylhexyl acrylate (B block)], poly[N,N-dimethyl-N-ethyl acrylate ammonium chloride (A block)-co-2-ethylhexyl acrylate (B block)], poly[N,N-dimethyl-N-ethyl methacrylate ammonium bromide (A block)-co-N,N-dibutyl methacrylamide (B block)], poly[N,N-dimethyl-N-ethyl methacrylate ammonium tosylate (A block)-co-N,N-dibutyl methacrylamide (B block)], poly[N,N-dimethyl-N-ethyl methacrylate ammonium bromide (A block)-co-N,N-dibutylacrylamide (B block)], poly[N,N-dimethyl-N-ethyl methacrylate ammonium tosylate (A block)-co-N,N-dibutylacrylamide (B block)], poly[4-vinyl-N,N-dimethylanilinium bromide (A block)-co-2-ethylhexyl methacrylate (B block)], poly[4-vinyl-N,N-dimethylanilinium tosylate (A block)-co-2-ethylhexyl methacrylate (B block)], poly[ethylenimmonium bromide (A block)-co-2-ethylhexyl methacrylate (B block)], and poly [propylenimmonium bromide (A block)-co-2-ethylhexyl methacrylate (B block)].

Examples of the second surfactants present in various effective amounts include aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis[monoalkyl salicylic] aluminate; hydroxy bis [dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis [dialkylated hydroxy naphthoic acid] aluminate wherein alkyl preferably contains 1 to about 6 carbon atoms; bis [trialkylated hydroxy naphthoic acid] aluminate wherein alkyl preferably contains 1 to about 6 carbon atoms; bis [tetraalkylated hydroxy naphthoic acid] aluminate wherein alkyl preferably contains 1 to about 6 carbon atoms; and the like. The aforementioned additives can be prepared as illustrated in U.S. Pat. No. 5,223,368, the disclosure of which is totally incorporated herein by reference.

In a preferred mixture, the conductive charge neutralizing solution includes a mixture having a ratio of total solids to fluid of approximately 30 percent solids to 70 percent fluids, wherein the total solids consist of the first surfactant charge additive and the second surfactant charge additive, and the fluid consists of the nonpolar liquid carrier. However, it will be noted that the mixture may have a total solids to fluid ratio of approximately 10 percent solids to 90 percent fluids and even as low as 1 percent solids to 99 percent fluids so long as the desired conductivity is achieved.

In a specific embodiment, a liquid carrier, of the type identified herein, includes a mixture of the surfactants indicated herein, and wherein the mixture contains from about 5 to about 95 weight percent of the first polymeric ammonium HBr salt component surfactant and from about 95 to 5 weight percent of the second aluminum hydroxy-carboxylic acid charge additive or adjuvant component, and preferably from about 70 to about 85 weight percent of the first polymeric ammonium HBr salt component surfactant and from about 30 to about 15 weight percent of the ALOHAS (aluminum hydroxy carboxylic acid) component. In this preferred mixture, the conductivity of the liquid charge neutralizer is greater than about 1,500 pmho/centimeter.

FIG. 2 illustrates the relationship between the low field conductivity and the amount of a mixture of poly[N,N-dimethyl-N-ethyl methacrylate ammonium bromide (A block)-co-2-ethylhexyl methacrylate (B block)] salt (HBr Quat) and hydroxy bis[3,5-di-t-butyl salicylic] aluminate monohydrate (ALOHAS) wherein the total weight of the solids in solution is fixed at 0.1 weight percent in NORPAR 15®. The conductivity of the fluid is dramatically enhanced by mixing the polymeric ammonium HBr salt surfactant with the salicylic aluminate adjuvant. The optimum conductivity of NORPAR 15® containing a total of 0.1 weight percent of the aforementioned surfactant and adjuvant is obtained when 80 percent of the solids is comprised of polymeric ammonium HBr salt poly[N,N-dimethyl-N-ethyl methacrylate ammonium bromide (A block)-co-2 ethyl hexyl methacrylate (B block)], and 20 percent is the salicylic aluminate as hydroxy bis[3,5-di-t-butyl salicylic] aluminate monohydrate shown in FIG. 2. The preferred conductivity range is greater than 100 pmho/centimeter, and for example, from about 500 to about 1,700 pmho/centimeter.

A specific fluid composition prepared from a mixture of the surfactants comprised of 0.08 weight percent of the above HBr Quat surfactant and 0.02 weight percent of the above ALOHAS surfactant. The mixture of surfactants yielded an ionic conductivity of about 700 pmho/centimeter, approximately two orders of magnitude greater than the ionic conductivity of the individual component surfactant solutions. This particular ratio of 4 parts of HBr Quat to 1 part of ALOHAS corresponded to the composition of maximum ionic conductivity. Other modifications of the present invention may occur to those of ordinary skill in the art subsequent to a review of the present application and these modifications, including equivalents thereof, are intended to be included within the scope of the present invention.

In review, a method and apparatus for eliminating residual charge potential in a multicolor electrostatographic system has been described. The process of the present invention includes the application of a transparent conductive solution to a developed image for substantially neutralizing any charge potential therein prior to subsequent development of a superimposed image. An apparatus for applying a thin layer of charge neutralizing material to the developed image has been disclosed. In addition, various solutions have been described which may be advantageously utilized to provide a charge neutralizing material in the form of a surfactant charge additive in the context of the present invention.

It is, therefore, apparent that there has been provided, in accordance with the present invention, a method and apparatus for eliminating residual charge potential in an electrostatographic system, and, more particularly, an image-on-image multicolor system, wherein individually developed images are treated with a transparent conductive solution prior to formation of a superimposed electrostatic latent image so as to eliminate residual charge potentials which can attract toner particles in a subsequent image development procedure. This apparatus fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. An electrostatographic printing machine for producing a multicolor output image from an input image signal, comprising:

a recording medium adapted to have a plurality of latent electostatic images recorded thereon;

means for generating a first electrostatic latent image on said recording medium corresponding to a first color separation of the input image signal;

means for developing the first electrostatic latent image on said recording medium with a developing material to produce a first developed image thereon;

means for generating a second electrostatic latent image on said recording medium corresponding to a second color separation of the input image, said second electrostatic latent image being superimposed on said first developed image on said recording medium;

means for developing the second electrostatic latent image on said recording medium with a developing material to produce a second developed image thereon; and means for applying a conductive solution to said first developed image prior to formation of said second electrostatic latent image superimposed thereon, said conductive solution including a charge neutralizing material operative to substantially eliminate residual charge potentials which may remain on said recording medium from said first electrostatic latent image after development thereof.

2. The electrostatographic printing machine of claim 1, wherein said means for applying a conductive solution includes a post-development treatment station including:

a liquid material applicator adapted to transport liquid material into contact with said recording medium; and a metering roll situated adjacent said liquid material applicator and downstream therefrom relative to a path of travel of the recording medium.

3. The electrostatographic printing machine of claim 2, wherein said liquid material applicator includes a housing defining an elongated aperture adapted for transporting liquid material into contact with the recording medium for providing a liquid material application region in which the conductive solution can flow freely in contact with the recording medium.

4. The electrostatographic printing machine of claim 2, further including means for rotating said metering roll in a direction opposite the path of travel of the recording medium to create a shear force for minimizing a thickness of the liquid material thereon.

5. The electrostatographic printing machine of claim 2, further including means for electrically grounding said metering roll for providing an electrical path to permit residual charge potential to flow away from said recording medium.

6. The electrostatographic printing machine of claim 2, wherein said liquid material applicator includes an input port coupled thereto for supplying the liquid material thereto.

7. The electrostatographic printing machine of claim 3, wherein said liquid material applicator further includes a drainage channel for allowing excess liquid material to flow away from the liquid material application region.

8. The electrostatographic printing machine of claim 1, wherein said recording medium includes a photoconductive imaging member.

9. The electrostatographic printing machine of claim 1, wherein said recording medium includes a dielectric member of the type generally utilized in an ionographic printing machine.

10. The electrostatographic printing machine of claim 1, wherein the conductive solution includes:

a nonpolar liquid carrier;

a mixture of a first surfactant charge additive having an ammonium AB diblock copolymer, with a B:A molar ratio from about 0.1:99.9 to about 99.9:0.1; and a second surfactant charge additive having an aluminum hydroxy carboxylic acid component for enabling a hydrocarbon soluble ionized fluid.

11. The electrostatographic printing machine of claim 10, wherein said first surfactant charge additive is a diblock copolymer selected from the group consisting of poly[2-dimethylammoniumethyl methacrylate bromide co-2-ethylhexyl methacrylate], poly[2-dimethylammoniumethyl methacrylate tosylate co-2-ethylhexyl methacrylate], poly [2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], and poly[2-dimethylammoniumethyl methacrylate tosylate co-N,N-dibutylacrylamide].

12. The electrostatographic printing machine of claim 10, wherein the liquid carrier is an aliphatic hydrocarbon.

13. The electrostatographic printing machine of claim 10, wherein the second surfactant is selected from the group consisting of hydroxy bis[3,5-di-tert-butyl salicylic] aluminate, hydroxy bis[3,5-di-tert-butyl salicylic] aluminate monohydrate, hydroxy bis[3,5-di-tert-butyl salicylic] aluminate dihydrate, hydroxy bis[3,5-di-tert-butyl salicylic] aluminate tritetrahydrate, and mixtures thereof.

14. The electrostatographic printing machine of claim 10, wherein the first surfactant is present in an amount of from about 5 to about 95 weight percent, and the second surfactant is present in an amount of from about 95 to about 5 weight percent.

15. The electrostatographic printing machine of claim 10, wherein the first surfactant is present in an amount of about 80 weight percent, and the second surfactant is present in an amount of about 20 weight percent.

16. The electrostatographic printing process of claim 10, wherein the conductive solution includes a mixture having a ratio of total solids to fluid of approximately 30 percent solids to 70 percent fluids, wherein the total solids consist of the first surfactant charge additive and the second surfactant charge additive, and the fluid consists of the nonpolar liquid carrier.

17. The electrostatographic printing process of claim 10, wherein the conductive solution includes a mixture having a ratio of total solids to fluid of approximately 10 percent solids to 90 percent fluids, wherein the total solids consist of the first surfactant charge additive and the second surfactant charge additive, and the fluid consists of the nonpolar liquid carrier.

18. The electrostatographic printing process of claim 10, wherein the conductive solution includes a mixture having a ratio of total solids to fluid of approximately 1 percent solids to 99 percent fluids, wherein the total solids consist of the first surfactant charge additive and the second surfactant charge additive, and the fluid consists of the nonpolar liquid carrier.

19. An electrostatographic printing process for producing a multicolor output image from an input image signal, comprising the steps of:

providing a recording medium adapted to have a plurality of latent electostatic images recorded thereon;

generating a first electrostatic latent image on said recording medium corresponding to a first color separation of the input image;

developing the first electrostatic latent image on said recording medium with a developing material to produce a first developed image thereon;

generating a second electrostatic latent image on said recording medium corresponding to a second color separation of the input image, said second electrostatic latent image being superimposed on said first developed image on said recording medium;

developing the second electrostatic latent image on said recording medium with a developing material to produce a second developed image thereon; and applying a conductive solution to said first developed image prior to formation of said second electrostatic latent image superimposed thereon, said conductive solution including a charge neutralizing material operative to substantially eliminate residual charge potentials which may remain on said recording medium from said first electrostatic latent image after development thereof.

20. The electrostatographic printing process of claim 19, wherein said step for applying a conductive solution includes:

transporting the conductive solution in the form of a liquid material into contact with said recording medium; and metering the liquid material in contact with said recording medium downstream from a liquid material application region relative to a path of travel of the recording medium for minimizing a thickness of the liquid material thereon.

21. The electrostatographic printing process of claim 19, wherein the conductive solution includes:

a nonpolar liquid carrier;

a mixture of a first surfactant charge additive having an ammonium AB diblock copolymer, with a B:A molar ratio from about 0.1:99.9 to about 99.9:0.1; and a second surfactant charge additive having an aluminum hydroxy carboxylic acid component for enabling a hydrocarbon soluble ionized fluid.

22. The electrostatographic printing process of claim 21, wherein said first surfactant charge additive is a diblock copolymer selected from the group consisting of poly[2-dimethylammoniumethyl methacrylate bromide co-2-ethylhexyl methacrylate], poly[2-dimethylammoniumethyl methacrylate tosylate co-2-ethylhexyl methacrylate], poly [2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], and poly[2-dimethylammoniumethyl methacrylate tosylate co-N,N-dibutylacrylamide].

23. The electrostatographic printing process of claim 21, wherein the liquid carrier is an aliphatic hydrocarbon.

24. The electrostatographic printing process of claim 21, wherein the second surfactant is selected from the group consisting of hydroxy bis[3,5-di-tert-butyl salicylic] aluminate, hydroxy bis[3,5-di-tert-butyl salicylic] aluminate monohydrate, hydroxy bis[3,5-di-tert-butyl salicylic] aluminate dihydrate, hydroxy bis[3,5-di-tert-butyl salicylic] aluminate tritetrahydrate, and mixtures thereof.

25. The electrostatographic printing process of claim 21, wherein the first surfactant is present in an amount of from about 5 to about 95 weight percent, and the second surfactant is present in an amount of from about 95 to about 5 weight percent.

26. The electrostatographic printing process of claim 21, wherein the first surfactant is present in an amount of about 80 weight percent, and the second surfactant is present in an amount of about 20 weight percent.

27. The electrostatographic printing process of claim 19, wherein the conductive solution includes a mixture having a ratio of total solids to fluid of approximately 30 percent solids to 70 percent fluids, wherein the total solids consist of the first surfactant charge additive and the second surfactant charge additive, and the fluid consists of the nonpolar liquid carrier.

28. The electrostatographic printing process of claim 19, wherein the conductive solution includes a mixture having a ratio of total solids to fluid of approximately 10 percent solids to 90 percent fluids, wherein the total solids consist of the first surfactant charge additive and the second surfactant charge additive, and the fluid consists of the nonpolar liquid carrier.

29. The electrostatographic printing process of claim 19, wherein the conductive solution includes a mixture having a ratio of total solids to fluid of approximately 1 percent solids to 99 percent fluids, wherein the total solids consist of the first surfactant charge additive and the second surfactant charge additive, and the fluid consists of the nonpolar liquid carrier.

* * * * *